US005304314A

United States Patent [19]

Hsu et al.

[11] Patent Number: 5,304,314

[45] Date of Patent: * Apr. 19, 1994

[54] SULFUR-CONTAINING ESTER DERIVATIVES OF ARYLAMINES AND HINDERED PHENOLS AS MULTIFUNCTIONAL ANTIWEAR AND ANTIOXIDANT ADDITIVES FOR LUBRICANTS

[75] Inventors: Shih-Ying Hsu, Morrisville, Pa.; Andrew G. Horodysky, Cherry Hill, N.J.

[73] Assignee: Mobil Oil Corporation, Fairfax, Va.

[ * ] Notice: The portion of the term of this patent subsequent to Apr. 6, 2010 has been disclaimed.

[21] Appl. No.: 815,011

[22] Filed: Dec. 27, 1991

[51] Int. Cl.[5] ..... C10M 129/10; C10M 159/16

[52] U.S. Cl. ..... 252/47.005; 252/404; 252/402; 564/162

[58] Field of Search ..... 252/47.5, 402, 404; 564/162

[56] References Cited

U.S. PATENT DOCUMENTS

| | | | |
|---|---|---|---|
| 4,761,482 | 8/1988 | Karol | 548/142 |
| 4,786,425 | 11/1988 | Horodysky et al. | 252/47.5 |
| 4,828,733 | 5/1989 | Farng et al. | 252/42.7 |
| 4,859,355 | 8/1989 | Chibnik | 252/47.5 |
| 4,863,622 | 9/1989 | Chiu | 252/47.5 |
| 4,919,831 | 4/1990 | Horodysky | 252/47.5 |
| 5,037,569 | 8/1991 | Salomon | 252/48.2 |

*Primary Examiner*—Jacqueline V. Howard

*Attorney, Agent, or Firm*—Alexander J. McKillop; Malcolm D. Keen; Howard M. Flournoy

[57] ABSTRACT

Sulfur-containing ester derivatives of arylamines and hindered phenols have been found to be effective antioxidant and antiwear additives for lubricants.

17 Claims, No Drawings

SULFUR-CONTAINING ESTER DERIVATIVES OF ARYLAMINES AND HINDERED PHENOLS AS MULTIFUNCTIONAL ANTIWEAR AND ANTIOXIDANT ADDITIVES FOR LUBRICANTS

BACKGROUND OF THE INVENTION

1. Field of the Invention

This invention is concerned with sulfur-containing arylamine and hindered phenol-derived antioxidant and antiwear additives for liquid hydrocarbon fuels and lubricants.

2. Description of Related Art

Arylamines and hindered phenols have been generally regarded as primary oxidation inhibitors and sulfur-containing compounds as secondary oxidation inhibitors for lubricants.

Additionally, U.S. Pat. No. 4,828,733 (Farng et al.) discloses the use of copper salts of hindered phenolic carboxylates and mixtures thereof with phenolic and arylamines, including hindered phenols and sulfur-containing phenols as effective antioxidants.

BRIEF SUMMARY OF THE INVENTION

This application is predicated on the discovery that specific combinations of arylamines and/or hindered phenols with sulfur-containing compounds can frequently result in a synergistic mixture and give a much enhanced antioxidative additive for lubricants and fuels. The present application discloses such unexpected synergistic combinations of arylamines or hindered phenols derivatized with sulfur-containing compounds for lubricant compositions. Similar benefits are expected with the use of these compositions in fuel formulations. Possible benefits include cleanliness, thermal stabilizing, detergency, antifatigue, emulsive/demulsive and corrosion inhibiting properties for both fuels and lubricants.

This class of antioxidants has the characteristics of both arylamines and phenols in one potion of the molecule coupled through acid anhydrides and thioesters. We have found that these novel compositions are very effective antioxidant and antiwear additives for both mineral and synthetic lubricants. To the best of our knowledge, the syntheses and applications of this family of compounds in lubricant and fuel compositions have not been disclosed elsewhere and are novel.

It is therefore an object of this invention to provide lubricant and fuel compositions having improved multifunctional antioxidant and antiwear characteristics.

DESCRIPTION OF PREFERRED EMBODIMENTS

The arylamine and hindered phenol-derived antioxidation and antiwear compounds can be generally prepared as described in FIG. 1. The hindered phenol (commercially obtained from Ethyl Corp. as Ethanox 754) and arylamine (commercially obtained from Vanderbilt Corp. as Vanlube 81) shown here are only for demonstration purposes; other hindered phenols and arylamines can also be effectively used. The reaction sequences described in FIG. 1 can be divided into two stages. The first stage involved reaction of the hindered phenol (as exemplified by Ethanox 754) with acid anhydrides and glycol dimercaptoacetate. The second stage involves reaction of the resulting products from the first stage with one more equivalent of acid anhydride and an equivalent of an arylamine or mixture of arylamines. A variety of acid anhydrides can be used to prepare this category of compounds as specified below. In addition to glycol dimercaptoacetate, other thioesters have been used in the preparation generally described in FIG. 1, such as trimethylolpropane trimercaptopropionate, pentaerythritol tetramercaptopropionate, etc. The reaction products obtained have good solubility in mineral and synthetic base stocks and display good antioxidancy and antiwear performance.

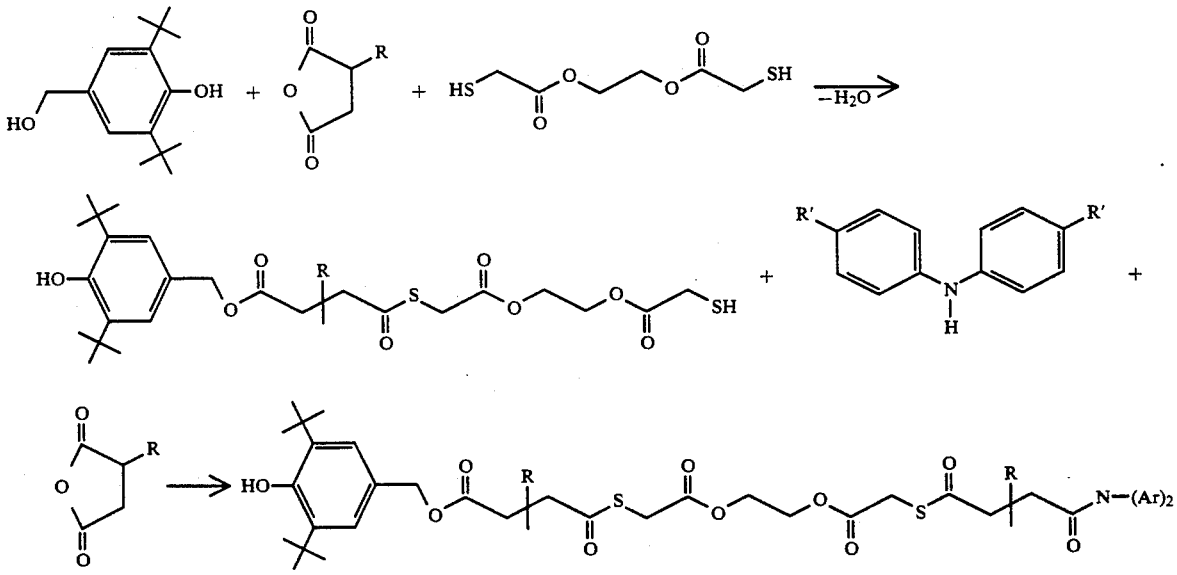

(Figure 1)

Where R=hydrocarbyl, preferably $C_1$–$C_{300}$, such as alkyl or alkenyl or a polyhydrocarbyl such as polyisobutenyl, or polypropenyl; R'=hydrocarbyl, preferably $C_1$–$C_{18}$, such as alkyl, or aryl alkenyl and can optionally contain sulfur, nitrogen and/or oxygen or mixtures thereof and Ar=aryl, preferably $C_6$–$C_{36}$.

If trimethylolpropane trimercaptopropionate is used for derivatization as shown in FIG. 1, several possible combinations of final products, which can be obtained by reacting trimethylol trimercaptopropionate with three equivalents of an acid anhydride, a hindered phenol and an arylamine, are shown FIG. 2 in a simplified version. A detailed description of reaction conditions will be given in Example 2. Similar types of products can be synthesized if pentaerythritol tetramercaptopropionate is used. A simplified representation of possible combinations of final products is shown in FIG. 3. A detailed description of reaction conditions is disclosed in Example 3.

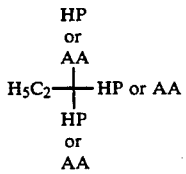

(Figure 2)

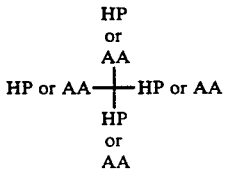

(Figure 3)

Where HP = hindered phenol
AA = arylamine

+ Other related products

Suitable arylamines include, but are not limited to, alkylated arylamines, oxidized arylamines, diarylamines, alkylated diarylamines as well as quinoline, phenyl-alpha-naphthyl amines, diphenylamine derivatives, phenylenediamines and the like. Highly useful is di(octylphenyl)amine.

Any suitable sulfur-containing compound may be used. Preferred are thioesters such as the following but not limited thereto: glycol dimercaptoacetate, trimethylolpropane trimercaptopropionate, pentaerythritol tetramercaptopropionate and the like.

Any suitable hindered phenol may be used including but not limited to 2,6-t-butyl-4-hydroxymethylphenol, 2,6-di-t-butoxyphenol, 2,6-di-t-butyl phenol, 2,6-di-t-butyl-4-carbobutoxyphenol, 3,5-t-butyl-4-hydroxybenzyl pivalate and the like. 2,6-t-butyl-4-hydroxymethylphenol is highly useful.

Highly useful acid anhydrides include but are not limited to maleic, succinic, phthalic, adipic and mixtures or derivatives thereof such as 2-dodecen-1-ylsuccinic anhydride.

Conditions for the reactions in accordance with the invention may widely vary depending upon specific reactants, the presence or absence of a solvent and the like. Any suitable set of reaction conditions known to the art may be used. Generally stoichiometric quantities of reactants are used. However, more than molar or less than molar amounts may be used. The reaction conditions may vary as follows: the reaction temperature may vary from 50° C. to about 250° C., the pressure may vary from about atmospheric or autogenous to about 500 psi and the molar ratio of reactants preferably varies respectively from about 1:1:1:1 moles to about (1-4):(1-4):(1-4):(1-4) moles of anhydride; sulfur compound; amine; and phenol.

Generally speaking, these reactions are carried out in the presence of a hydrocarbon solvent such as toluene, xylene or mixed xylenes.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %. It is expected that these materials would also be suitable for use in liquid hydrocarbyl or alcoholic or mixed hydrocarbyl/alcoholic or oxygenated fuel compositions. They are utilized in fuels in amounts of from about 25 to 500 pounds of additive per thousand barrels of fuel and preferably from about 50 to about 250 pounds per 1000 barrels of fuel.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. to about 6000 SSU at 100° F. and preferably, from about 50 to about 250 SSU at 210° F. These oils may have viscosity indexes ranging to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which is normally employed for thickening or gelling hydrocarbon fluids for foaming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl)

ether, phenoxy phenylethers. Ester-based lubricants are highly suitable.

The fuels contemplated as noted hereinabove are liquid hydrocarbon combustion fuels, including oxygenated and alcoholic fuels as well as distillate fuels and fuel oils.

It is to be understood, however, that the compositions contemplated herein can also contain other materials. For example, corrosion inhibitors, extreme pressure agents, low temperature properties modifiers and the like can be used as exemplified respectively by metallic phenates sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are merely illustrative and not meant to be limitations.

EXAMPLE 1

A mixture of glycol dimercaptoacetate (21 g, 0.1 mol), 2,6-t-butyl-4-hydroxymethylphenol (also known as Ethanox 754) (23.6g, 0.1 mol), and 2-dodecen-1-ylsuccinic anhydride (26.6 g, 0.1 mol) in toluene (100 ml) was refluxed for 3 hours or until 1.8 ml water was collected. The yellowish solution was cooled to 25° C. and di(octylphenyl)amine (commercially obtained as Vanlube 81) (39.3 g, 0.1 mol) and 2-dodecen-1-ylsuccinic anhydride (26.6 g, 0.1 mol) were added. The mixture was refluxed for an additional three hours at elevated temperatures and the solvent was evaporated at elevated temperatures and reduced pressures to afford a yellowish oil (132 g).

EXAMPLE 2

A solution of trimethylolpropane trimercaptopropionate (19.3 g, 0.05 mol) and 2-dodecen-1-ylsuccinic anhydride (39.9 g, 0.15 mol) in toluene (100 ml) was refluxed for three hours and cooled to 25° C. To the resulting solution 2,6-t-butyl-4-hydroxymethylphenol (11.8 g, 0.05 mol) and di(octylphenyl)amine (39.3 g, 0.1 mol) were added and refluxed for 5 hours or until 0.9 ml water collected. The solvent was evaporated at elevated temperatures and reduced pressure to afford a yellowish oil (108 g).

EXAMPLE 3

The solution of pentaerythritol tetramercaptopropionate (24.4 g, 0.05 mol) and 2-dodecen-1-ylsuccinic anhydride (53.2 g, 0.2 mol) in toluene (100 ml) was refluxed for three hours at elevated temperatures and cooled to 25° C. To the resulting solution di(octylphenyl)amine and (59 g, 0.15 mol) and 2,6-t-butyl-4-hydroxymethylphenol (11.8 g, 0.05 mol) were added and refluxed for 5 hours or until 0.9 ml water was collected. The solvent was evaporated at elevated temperatures and reduced pressure to afford a yellowish oil (146 g).

EVALUATION

The arylamines and hindered phenols thus obtained were blended into mineral oils and evaluated for antioxidant performance by the Catalytic Oxidation Test at 325° F. for 72 hours (Table 1) and the Four-Ball Wear Test at 60 kg load/2000 rpm/200° F. for 30 min. (Table 2). A comparison of the oxidation-inhibiting characteristics of the novel products of this application, with other traditional commercial arylamine hindered phenol antioxidants in the same mineral oil, is also included in Table 1.

The Catalytic Oxidation Test may be summarized as follows: Basically the lubricant is subjected to a stream of air which is bubbled through the oil formulation at the rate of five liters per hour at 325° F. for 72 hours. Present in the composition are samples of metals commonly used in engine construction, namely iron, copper, aluminum and lead, see U.S. Pat. No. 3,682,980 incorporated herein by reference for further details.

The Catalytic Oxidation Test results confirm the excellent control in both acidity and viscosity increase. These additives demonstrate remarkable antioxidant properties at only 1% concentration levels.

TABLE 1

| | Catalytic Oxidation Test 72 hrs, 325° F. | | |
|---|---|---|---|
| Item | Additive Concentration (wt %) | Change in Acid Number Δ TAN | % Change in Viscosity, Δ KV (%) |
| Base oil (200 second, solvent refined, paraffinic neutral mineral oil) | None | 11.97 | 210 |
| Commercial Arylamine Antioxidant (Ciba-Geigy Irganox L-57) in above oil | 1.0 | 8.75 | 65.3 |
| Commerical Phenolic Antioxidant (Ethyl Corp., Ethyl 702) in above oil | 1.0 | 9.36 | 82.3 |
| Example 1 in above oil | 1.0 | 4.60 | 60.6 |

The antiwear properties of the examples were also evaluated using the *Four Ball Wear Test* as shown in Table 2. The results clearly exhibit the excellent antiwear properties inherent in these unique compositions.

In the Four Ball Test three stationary balls are placed in a lubricant cup and a lubricant containing the compound to be tested is added thereto, and a fourth ball is placed in a chuck mounted on a device which can be used to spin the ball at known speeds and loads. The examples were tested using half inch stainless steel balls of 5200 steel for thirty minutes under 60 kg load at 2000 rpm and 200° F. If additional information is desired consult test method ASTM D2266 and/or U.S. Pat. No. 4,761,482.

K (as reported in Table 2) the wear coefficient is calculated from the wear volume, V, of the stationary ball. The wear volume is calculated from the wear scar diameter D in mm as follows:

$V=[15{,}5\ D3-0.0103L]D\times10^{-3}$ mm3 where L is the machine load in kg. This equation considers the elastic deformation of the steel balls.

Wear Coefficient $K$

Dimensionless $K$ is defined as $K=\frac{VH}{dN}$ where $V$ = wear volume, mm3

$H$ = hardness 725 kg/mm2 for 52100 steel $d$ = (23.3 mm/rev) (RPM × Time)

$N$ = (0.408) (Load in kg)

TABLE 2

| Item | Four-Ball Wear Test 60 kg/2000 rpm/30 min/200° F. Additive Concentration | Wear Scar Diameter, mm | K factor $\times 10^8$ |
|---|---|---|---|
| Base oil (80% solvent paraffinic bright, and 20% solvent paraffinic neutral lubricant oils) | None | 3.48 | 4771 |
| Example 1 in above oil | 1.0 | 0.88 | 18.4 |
| Example 2 in above oil | 1.0 | 1.83 | 367 |
| Example 3 in above oil | 1.0 | 1.89 | 414 |

The Four-Ball Wear Test results again demonstrate the excellent antiwear properties of these compositions when used at only 1% concentration in mixed mineral oils.

It is clear from Table 1 that hindered phenols and arylamines derived with acid anhydrides and thioesters display better antioxidancy in mineral oils than commercial arylamines (Irganox L-57) and hindered phenols (Ethyl 702). In addition, these compounds also provide antiwear properties as evidenced by the data in Table 2. From these data, it can be concluded that the hindered phenols and arylamines-derivatized thioesters are both good antioxidants and antiwear additives and provide a combination of multifunctional performance advantages unavailable with prior art compositions.

The hindered phenols and arylamines derivatized with acid anhydrides and thioesters as described in this patent application are an entirely new class of compounds which exhibit good antioxidant and antiwear properties in lubricants under severe service conditions. These properties can enhance the thermal and oxidative stability of premium quality automotive and industrial lubricants to extend their service life. These compounds can be easily manufactured with known additive technologies.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. An improved lubricant composition comprising a major proportion of an oil of lubricating viscosity or grease prepared therefrom and a minor proportion of from about 0.001 to about 10% by weight based upon the total weight of the composition of a multifunctional antiwear, antioxidant additive product of reaction prepared by reacting arylamines, hindered phenols, sulfur-containing compounds and hydrocarbyl acid anhydrides in molar rations varying respectively from about 1:1:1:1 to (1-4):(1-4):(1-4):(1-4) moles, at temperatures varying from 50° C. to about 250° C., under pressures varying from ambient to about 500 psi for a time sufficient to obtain the desired additive product of reaction.

2. The composition of claim 1 wherein the additive product is prepared as generally described below:

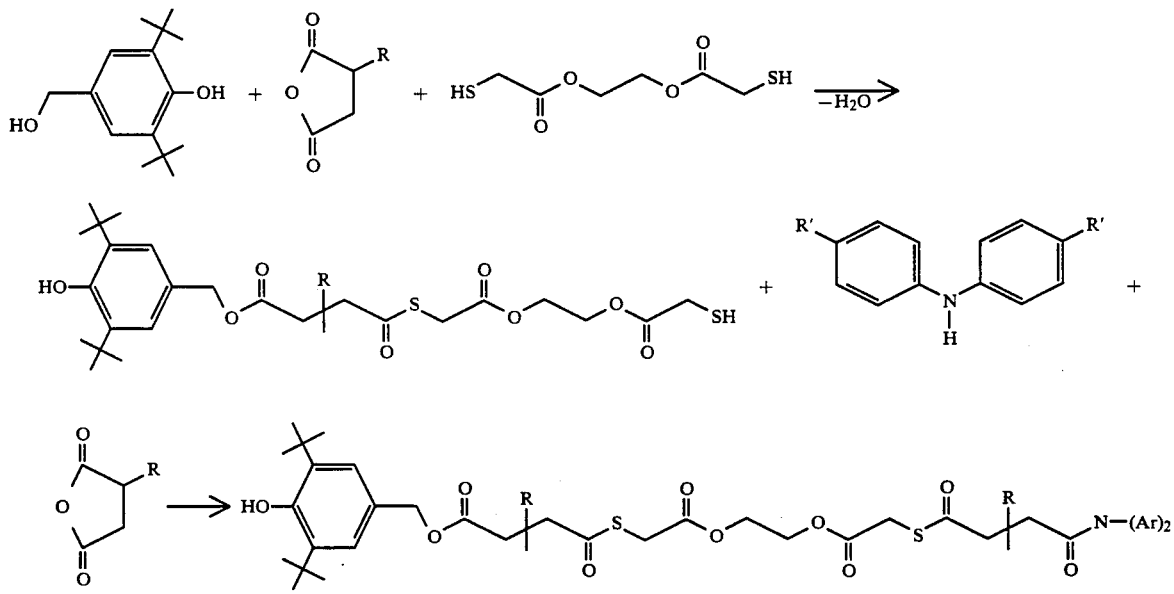

(1)

Where $R = C_1$–$C_{300}$ hydrocarbyl or polyhydrocarbyl; $R' = C_1$–$C_{18}$ hydrocarbyl, R and R' can optionally contain sulfur, nitrogen and/or oxygen or mixtures thereof and Ar = phenylene-R'.

3. The composition of claim 2 wherein the major portion of the product has the following structural formula:

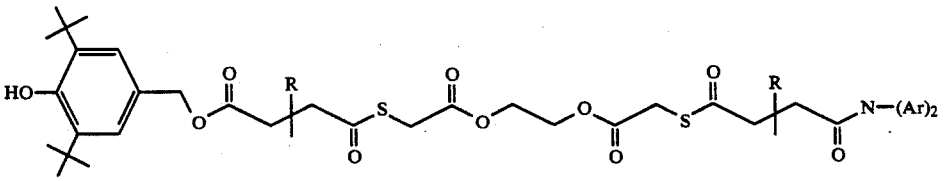

Wherein R = $C_1$–$C_{300}$ hydrocarbyl or polyhydrocarbyl; Ar = phenylene-R′ and wherein R optionally contains sulfur, nitrogen and/or oxygen or mixtures thereof.

4. The composition of claim 1 wherein the reactants are glycol dimercaptoacetate, 2,6-t-butyl-4-hydroxymethylphenol, 2-dodecen-1-ylsuccinic anhydride and di(octylphenyl)amine.

5. The composition of claim 1 wherein the reactants are trimethylolpropionate trimercaptopropionate, 2-dodecen-1-ylsuccenic anhydride, 2,6-t-butyl-4-hydroxymethylphenol and di(octylphenyl)amine.

6. The composition of claim 1 wherein the reactants are pentaerythritol tetramercaptopropionate, 2-dodecen-1-ylsuccinic anhydride, di(octylphenyl)amine and 2,6-t-butyl-4-hydroxymethylphenol.

7. The lubricant composition of claim 1 wherein said lubricant is an oil of lubricating viscosity selected from the group consisting of (1) mineral oils, (2) synthetic oils, (3) or mixtures of mineral and synthetic oils or is (4) a grease prepared from any one of (1), (2) or(3).

8. The composition of claim 8 wherein the lubricant contains from about 0.001 to about 10 wt % based on the total weight of the composition of the additive product of reaction.

9. A process of preparing a multifunctional antioxidant, antiwear additive product of reaction prepared by reacting hindered phenols, sulfur-containing compounds, hydrocarbyl acid anhydrides, and arylamines in molar ratios varying respectively from 1:1:1:1 to (1-4):(1-4):(1-4):(1-4) moles at temperatures varying from 50° C. to about 250° C. under pressures varying from autogenous to about 500 psi for a time sufficient to obtain the desired additive product of reaction.

10. The process of claim 9 wherein the product is prepared as generally described below:

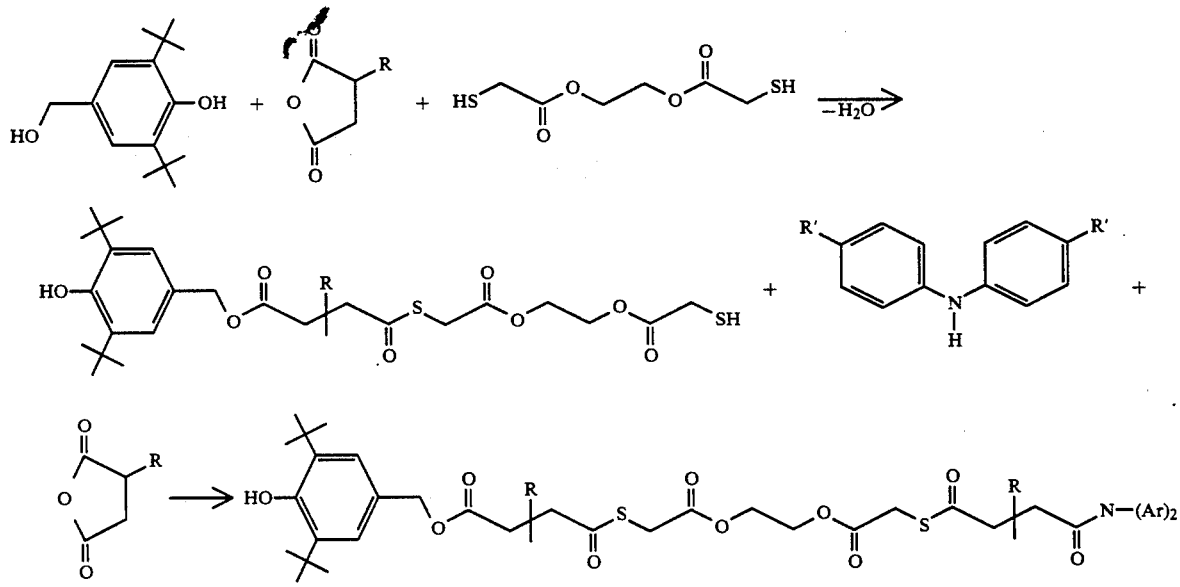

(1)

Where R = $C_1$–$C_{300}$ hydrocarbyl or polyhydrocarbyl; R′ = $C_1$–$C_{18}$ hydrocarbyl, and R and R′ can optionally contain sulfur, nitrogen and/or oxygen or mixtures thereof and Ar = phenylene-R′.

11. The process of claim 10 wherein the major portion of the produce has the following structural formula:

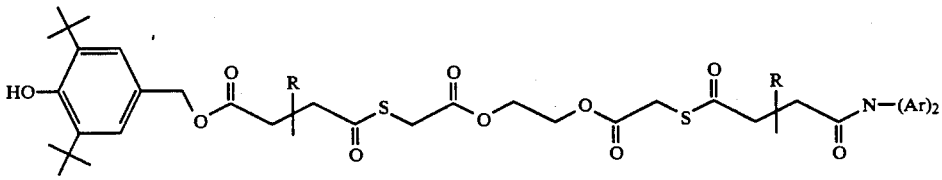

Wherein R = $C_1$–$C_{300}$ hydrocarbyl or polyhydrocarbyl, R optionally contains sulfur, nitrogen and/or oxygen or mixtures thereof and Ar = phenylene-R'.

12. The process of claim 9 wherein the reactants are glycol dimercaptoacetate, 2,6-t-butyl-4-hydroxymethylphenol, 2-dodecen-1-ylsuccinic anhydride and di(octylphenyl)amine.

13. The process of claim 9 wherein the reactants are trimethyolpropionate, 2-dodecen-1-ylsuccinic anhydride, 2,6-t-butyl-4-hydroxymethylphenol and di(octylphenyl)amine.

14. The process of claim 9 wherein the reactants are pentaerythritol tetramercaptopropionate, 2-dodecen-1-ylsuccinic anhydride, di(octylphenyl)amine and 2,6-t-butyl-4-hydroxymethylphenol.

15. A product of reaction prepared by reacting hindered phenols, sulfur-containing compounds, hydrocarbyl acid anhydrides, and arylamines in molar ratios varying respectively from about 1:1:1:1 to about (1-4):(1-4):(1-4):(1-4) moles at temperatures varying from 50° C. to about 250° C. under pressure varying from autogenous to about 500 psi for a time sufficient to obtain the desired additive product of reaction.

16. A product of reaction in accordance with claim 15 wherein the product is prepared as generally described below:

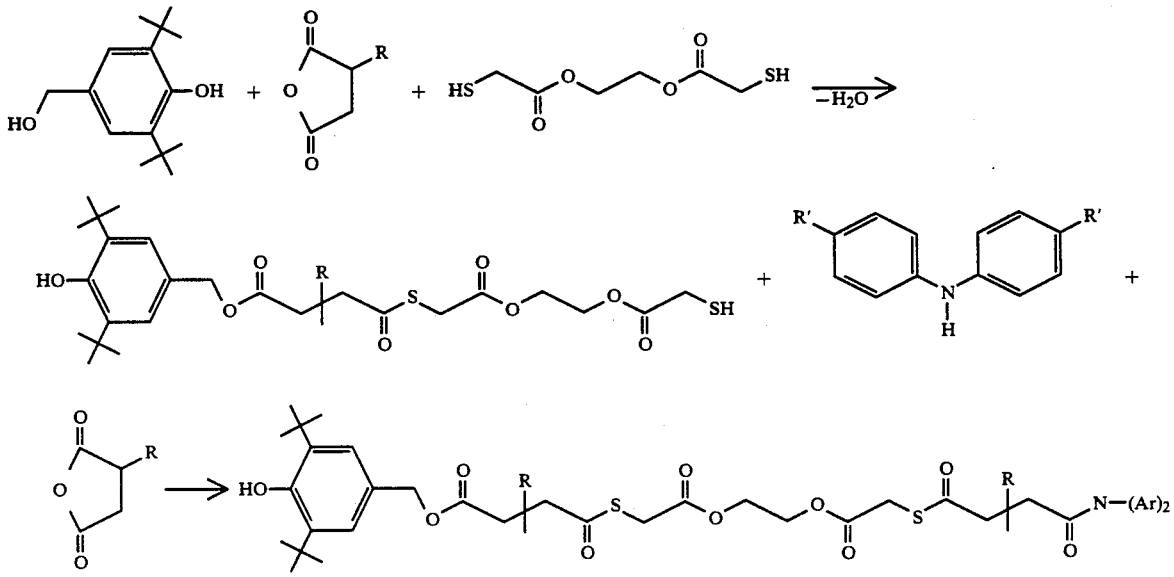

Where R = $C_1$–$C_{300}$ hydrocarbyl or polyhydrocarbyl; R' = $C_1$–$C_{18}$ hydrocarbyl, R and R' can optionally contain sulfur, nitrogen and/or oxygen or mixtures thereof and Ar = phenylene-R'.

17. The product of claim 16 wherein the major proportion of the product has the following structural formula:

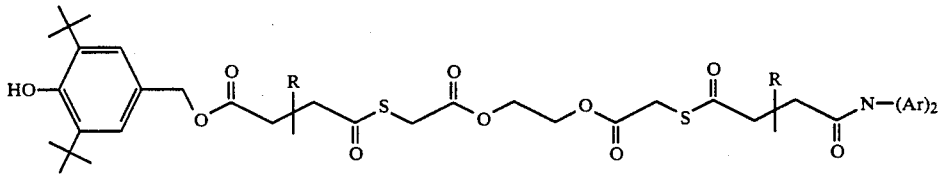

Where R = $C_1$–$C_{300}$ hydrocarbyl or polyhydrocarbyl and optionally contains sulfur, nitrogen and/or oxygen or mixtures thereof and AR = phenylene-R'.

* * * * *

UNITED STATES PATENT AND TRADEMARK OFFICE

CERTIFICATE OF CORRECTION

PATENT NO. : 5,304,314

DATED : April 19, 1994

INVENTOR(S) : Shih-Ying Hsu et al.

It is certified that error appears in the above-identified patent and that said Letters Patent is hereby corrected as shown below:

Col 8, Claim 1, line 21, delete "rations" insert --ratios--.

Col. 10, Claim 11, Line 2, delete "produce" insert --product--

Signed and Sealed this

Thirtieth Day of August, 1994

Bruce Lehman

*Attest:*

BRUCE LEHMAN

*Attesting Officer*

*Commissioner of Patents and Trademarks*